US008077119B2

(12) United States Patent
Iwami et al.

(10) Patent No.: US 8,077,119 B2
(45) Date of Patent: Dec. 13, 2011

(54) DISPLAY PANEL DRIVE APPARATUS HAVING A NOISE REDUCING DRIVER

(75) Inventors: Takashi Iwami, Chuo (JP); Tomoaki Tatsumi, Chuo (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 809 days.

(21) Appl. No.: 11/585,940

(22) Filed: Oct. 25, 2006

(65) Prior Publication Data

US 2007/0139304 A1 Jun. 21, 2007

(30) Foreign Application Priority Data

Dec. 15, 2005 (JP) ..... 2005-361432

(51) Int. Cl.
*G09G 3/28* (2006.01)

(52) U.S. Cl. ..... 345/60

(58) Field of Classification Search ..... 345/60–68; 315/169.4

See application file for complete search history.

(56) References Cited

U.S. PATENT DOCUMENTS

| | | | | |
|---|---|---|---|---|
| 5,835,072 | A * | 11/1998 | Kanazawa | 345/60 |
| 6,278,421 | B1 * | 8/2001 | Ishida et al. | 345/63 |
| 2002/0075034 | A1 * | 6/2002 | Schroeder et al. | 326/26 |
| 2003/0122744 | A1 * | 7/2003 | Fujita et al. | 345/63 |
| 2003/0184537 | A1 * | 10/2003 | Nagaoka | 345/204 |
| 2004/0135748 | A1 * | 7/2004 | Yoon et al. | 345/60 |
| 2005/0029960 | A1 * | 2/2005 | Roh et al. | 315/169.4 |
| 2005/0083257 | A1 * | 4/2005 | Iwami | 345/60 |
| 2005/0088108 | A1 * | 4/2005 | Iwami | 315/209 R |
| 2005/0122284 | A1 * | 6/2005 | Gates et al. | 345/60 |
| 2005/0218822 | A1 * | 10/2005 | Sano et al. | 315/169.4 |

FOREIGN PATENT DOCUMENTS

| | | |
|---|---|---|
| EP | 1 187 088 | 3/2002 |
| EP | 1 351 212 | 10/2003 |
| JP | 09-146490 | 6/1997 |
| JP | 2002-156941 | 5/2002 |
| JP | 2002-244614 | 8/2002 |
| JP | 2002-287691 | 10/2002 |
| JP | 2002-311894 | 10/2002 |
| JP | 2003-228320 | 8/2003 |
| JP | 2004-325705 | 11/2004 |
| JP | 2005-078098 | 3/2005 |
| JP | 2005-122176 | 5/2005 |
| JP | 2007-011193 | 1/2007 |

* cited by examiner

*Primary Examiner* — Chanh Nguyen
*Assistant Examiner* — Sanghyuk Park
(74) *Attorney, Agent, or Firm* — Drinker Biddle & Reath LLP

(57) ABSTRACT

A display panel drive apparatus which reduces noise to thereby prevent malfunction. A first switch connects based on pixel data between one of column electrodes of a display panel and a power supply line to which a pulsed supply voltage is applied. A second switch connects between the one column electrode and a ground line based on the pixel data. The first and second switches are used to apply pixel data pulses based on the pixel data to the one column electrode. In this scheme, the pixel data having a lower frequency in the vertical direction of the screen allows the second switch to send a smaller current to the ground line when compared with a case of the pixel data having a higher frequency.

7 Claims, 14 Drawing Sheets

DISPLAY PANEL DRIVE APPARATUS HAVING A NOISE REDUCING DRIVER

BACKGROUND OF THE INVENTION

1. Technical Field

The present invention relates to an apparatus for driving a display panel which has capacitive light-emitting elements disposed in a matrix.

2. Background Art

Currently, display panels such as plasma display panels (hereinafter referred to as a PDP) or electroluminescence display panels (hereinafter referred to as an ELP) which include capacitive light-emitting elements have been commercially available as wall-hanging TVs.

FIG. 1 is a view schematically illustrating the configuration of a plasma display device which employs a PDP as such a display panel (e.g., see FIG. 3 in Japanese Patent Kokai No. 2002-156941 (Patent Document 1)).

With reference to FIG. 1, a plasma display panel or PDP 10 includes row electrodes $Y_1$ to $Y_n$ and $X_1$ to $X_n$ arranged so that a pair of row electrodes X and Y adjacent to each other forms one display line of the screen. The PDP 10 also includes column electrodes $Z_1$ to $Z_m$ which are formed to be orthogonal to the aforementioned pairs of row electrodes and which are associated respectively with the columns (the first to mth columns) of the screen with a dielectric layer and a discharge space (not shown) interposed therebetween. Note that there is formed a pixel cell responsible for a pixel at the portion of intersection of a pair of row electrodes (X, Y) and one column electrode Z.

A row electrode drive circuit 30 produces a sustain pulse to repetitively discharge only such a pixel cell as having residual wall charge for application to the row electrodes $Y_1$ to $Y_n$ of the PDP 10. A row electrode drive circuit 40 produces a reset pulse to initialize the state of all the pixel cells, a scan pulse to sequentially select a display line on which pixel data is to be written, and a sustain pulse to repetitively discharge only such a pixel cell as having residual wall charge. The row electrode drive circuit 40 applies these pulses to the aforementioned row electrodes $X_1$ to $X_n$.

A drive control circuit 50 converts an input video signal, e.g., to 8-bit pixel data on a pixel-by-pixel basis, which is in turn divided into a pixel data bit DB by bit digit. Then, on each display line basis, the drive control circuit 50 supplies pixel data bits $DB_1$ to $DB_m$ to a column electrode drive circuit 20. Here, the pixel data bits $DB_1$ to $DB_m$ are associated respectively with the first to mth columns and belong to each display line. Meanwhile, the drive control circuit 50 also produces switching signals SW1 to SW3 for supply to the column electrode drive circuit 20.

In response to the switching signals SW1 to SW3, each time one display line of (m) pixel data bits DB are supplied from the drive control circuit 50, the column electrode drive circuit 20 produces m pixel data pulses DP, each having a pulsed voltage associated with the logic level of each pixel data bit DB. The column electrode drive circuit 20 then applies the m pixel data pulses DP to the column electrodes $Z_1$ to $Z_m$, respectively. That is, in each predetermined pixel data cycle, the column electrode drive circuit 20 sequentially applies a display line of m pixel data pulses to the column electrodes $Z_1$ to $Z_m$, respectively, the (m) pixel data pulses being associated with each of the first to nth display lines. For example, the column electrode drive circuit 20 first applies the m pixel data pulses associated with the first display line respectively to the column electrodes $Z_1$ to $Z_m$ during the first pixel data cycle. The column electrode drive circuit 20 then applies the m pixel data pulses associated with the second display line respectively to the column electrodes $Z_1$ to $Z_m$ during the next second pixel data cycle. FIG. 2 is a view illustrating the internal configuration of such a column electrode drive circuit 20.

As shown in FIG. 2, the column electrode drive circuit 20 includes a power supply circuit 21 for producing a pulsed supply voltage of predetermined amplitude for application to a power supply line 2, and a pixel data pulse generation circuit 22 for producing the pixel data pulses DP in accordance with such a pulsed supply voltage.

As shown in FIG. 3, during each pixel data cycle CYC, the power supply circuit 21 produces a pulsed supply voltage having a peak voltage Va for application to the power supply line 2 in response to the switching signals SW1 to SW3 supplied from the drive control circuit 50. This is done to provide ON/OFF control to each of switching elements S1 to S3 in a sequence of drive steps G1 to G3. That is, in the drive step G1, the switching element S1 of the power supply circuit 21 is turned ON, thereby causing the charge stored on a capacitor C1 to be discharged. At this time, suppose that a SWZi of switching elements $SWZ_1$ to $SWZ_m$ in the pixel data pulse generation circuit 22 is in an ON state. In this case, a current caused by a discharge of the capacitor C1 flows into the column electrode Zi of the PDP 10 via the switching element S1, a coil L1, a diode D1, the power supply line 2, and the switching element SWZi. Thus, a parasitic load capacitance $C_0$ of the column electrode Zi is charged to store charges thereon. Such a discharge operation of the capacitor C1 causes the power supply line 2 to increase in voltage gradually to twice a potential Vc at an end of the capacitor due to the resonance effect of the coil L1 and the load capacitance $C_0$. Then, in the drive step G2, only the switching element S3 of the switching elements S1 to S3 is turned ON, thereby causing a DC voltage Va produced by a DC power supply B1 to be applied to the power supply line 2 via the switching element S3. At this time, the aforementioned voltage Va is at the peak voltage of the pulsed supply voltage as shown in FIG. 3. The voltage Va applied to the power supply line 2 causes a current to flow into the column electrode Zi of the PDP 10 via the switching element SWZi, allowing for charging the parasitic load capacitance $C_0$ of the column electrode Zi to store charges thereon. Then, in the drive step G3, only the switching element S2 of the switching elements S1 to S3 is turned ON, thereby allowing the load capacitance $C_0$ of the PDP 10 to initiate a discharge. Such a discharge results in a current flowing into the capacitor C1 via the column electrode Zi, the switching element SWZi, the power supply line 2, a coil L2, a diode D2, and the switching element S2. That is, the charge stored on the load capacitance $C_0$ of the PDP 10 is transferred back to the capacitor C1 in the power supply circuit 21. At this time, the voltage on the power supply line 2 gradually decreases as shown in FIG. 3 in accordance with the time constant defined by the coil L2 and the load capacitance $C_0$. Here, the gradually decreasing potential portion on the power supply line 2 as mentioned above is the trailing edge portion of the pulsed supply voltage.

The switching element SWZi (i: 1 to m) of the pixel data pulse generation circuit 22 is turned ON when the pixel data bit DB supplied is at logic level "1," thereby causing the pulsed supply voltage on the power supply line 2 to be applied to the column electrode Zi. As such, the pixel data pulse DP of a high voltage is to be applied to column electrodes Zi. On the other hand, a switching element $SWZ_{i0}$ (i: 1 to m) of the pixel data pulse generation circuit 22 is turned ON when the pixel data bit DB is at logic level "0," thereby causing a ground potential or "0" volt to be applied to the column electrode Zi.

As such, the pixel data pulse DP of a low voltage is to be applied to the column electrode Zi.

FIG. 4 is a view illustrating how the column electrode drive circuit 20 operates to sequentially apply each of the pixel data pulses $DP_{1i}$ to $DP_{6i}$ associated respectively with the first to sixth display lines to the column electrode Zi (i: 1 to m), where only the column electrode Zi of the PDP 10 is shown for clarity. Note that FIG. 4 shows the operation to be performed when a bit train of pixel data bits DB associated respectively with the first to sixth display lines is [1, 1, 1, 1, 1, 0].

Here, the pixel data bits DB associated respectively with the first to fifth display lines are successively at logic level "1," during which the switching element SWZi is in an ON state and the switching element $SWZ_{i0}$ is fixed in an OFF state as shown in FIG. 4. Accordingly, when the operation shown in FIG. 3 is repeated over pixel data cycles CYC1 to CYC5, those charges that could not be recovered in the drive step G3 of each of the CYC1 to CYC5 are gradually stored on the load capacitance $C_0$ of the PDP 10. As a result, the pulsed supply voltage applied to the power supply line 2 gradually decreases in its resonance amplitude $V_1$ as shown in FIG. 4 while being maintained at its maximum potential Va. Thus, the charge/discharge operations that would be otherwise caused by the aforementioned resonance effect will not occur, thereby suppressing reactive power.

Then, when the pixel data bit DB at logic level "0" associated with the sixth display line is supplied in the pixel data cycle CYC6 next to the pixel data cycle CYC5, the aforementioned switching element SWZi switches to an OFF state and the switching element $SWZ_{i0}$ to an ON state. The switching element $SWZ_{i0}$ being switched to the ON state causes the column electrode Zi to be connected to the ground, resulting in the voltage on the column electrode Zi being changed to 0 volt. However, as shown with EG in FIG. 4, a sudden change in the voltage on the column electrode Z from a relatively high potential to 0 volt would likely cause a high level noise and malfunction of the drive circuit.

SUMMARY OF THE INVENTION

The present invention was developed in view of such problems. It is therefore an object of the present invention to provide a display panel drive apparatus which is reduced in noise to thereby prevent malfunction.

A display panel drive apparatus according to an aspect of the present invention drives a display panel on pixel-by-pixel basis in accordance with pixel data derived from an input video signal, the display panel having a capacitive pixel cell at each portion of intersection of a plurality of row electrodes and a plurality of column electrodes. The drive apparatus includes: a power supply circuit for producing a pulsed supply voltage having a predetermined peak voltage for application to a power supply line; and a pixel data pulse generation circuit for producing a pixel data pulse having a voltage associated with the pixel data in accordance with the pulsed supply voltage for application to the column electrode. The pixel data pulse generation circuit includes a first switch for connecting between the power supply line and one of the column electrodes in accordance with the pixel data, and a second switch for connecting the one column electrode to a ground line in accordance with the pixel data. The second switch varies an amount of current to be sent to the ground line in accordance with a drive mode.

According to the present invention, the first switch connects between one of the column electrodes of a display panel and a power supply line to which a pulsed supply voltage is applied, in accordance with pixel data, and the second switch connects between the one column electrode and a ground line in accordance with the pixel data. The first and second switches are used to apply a pixel data pulse based on the aforementioned pixel data to the one column electrode. At this time, the pixel data having a lower frequency in the vertical direction of the screen causes the second switch to send a smaller current to the ground line when compared with a case of the pixel data having a higher frequency. Thus, the column electrode varies gradually in voltage. This is allowed even when the pixel data pulses applied to the column electrode change successively from a high voltage to a low voltage (0 volt) as the pulsed supply voltage is reduced in amplitude while being maintained at its peak voltage because the pixel data has a lower frequency in the vertical direction of the screen. It is thus possible to reduce noise caused otherwise by the variation in voltage when compared with a case where the voltage on the column electrode suddenly changes from a high voltage to a low voltage (0 volt).

DETAILED DESCRIPTION OF THE INVENTION

Now, the present invention will be described below in more detail with reference to the accompanying drawings in accordance with the embodiments.

Figure 5:
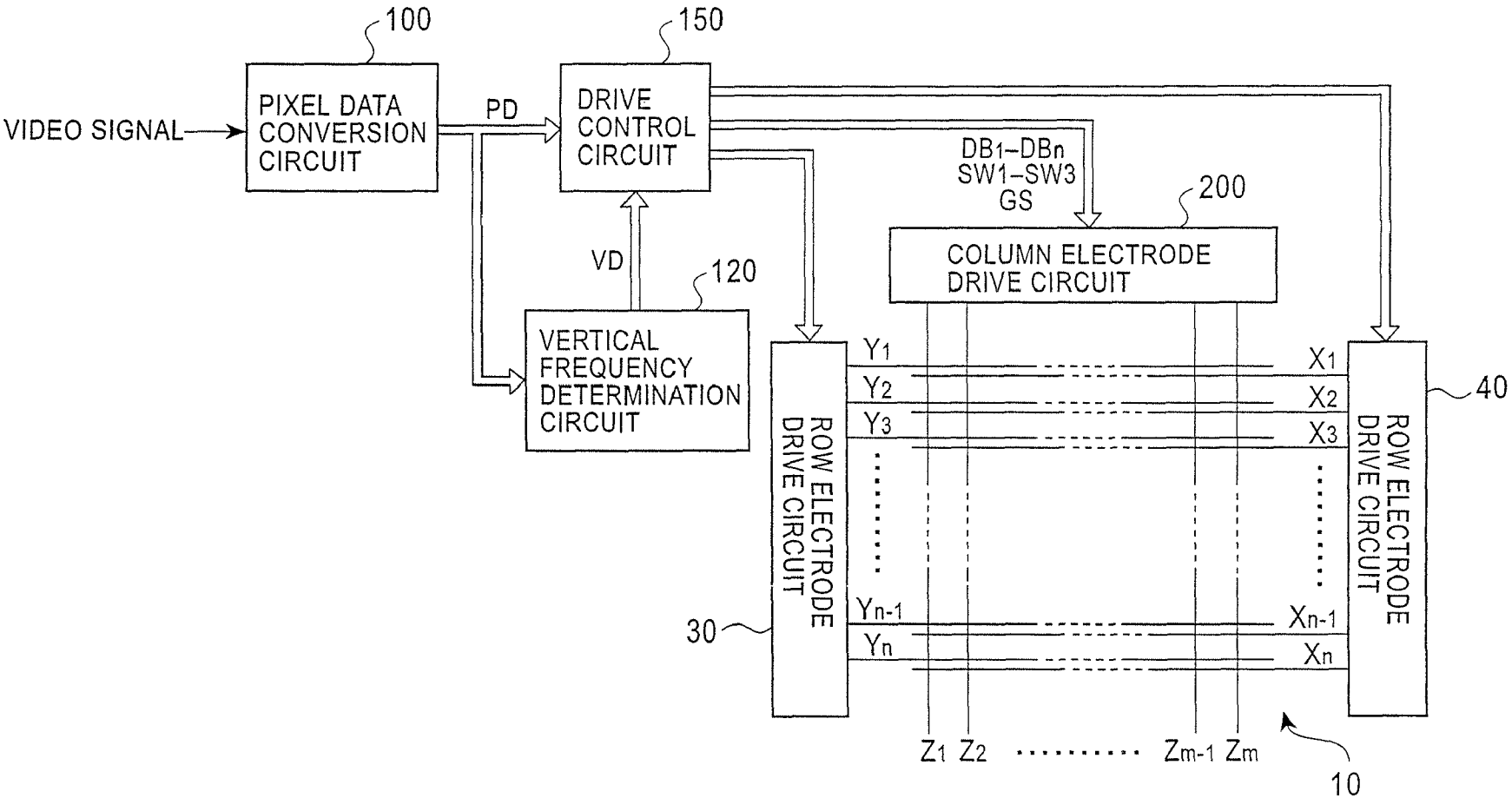
FIG. 5 is a view illustrating an exemplary configuration of a plasma display device incorporating a display panel drive apparatus according to the present invention.

FIG. 5 is a view schematically illustrating the configuration of a plasma display device incorporating a PDP as a display panel.

With reference to FIG. 5, a plasma display panel or a PDP 10 includes column electrodes $Z_1$ to $Z_m$ each formed to extend in the longitudinal (vertical) direction of the two-dimensional display screen and row electrodes $X_1$ to $X_n$ and row electrodes $Y_1$ to $Y_n$, each formed to extend in the lateral (horizontal) direction with X and Y being alternately disposed. Note that a pair of row electrodes X and Y adjacent to each other serves as one display line of the PDP 10. That is, the PDP 10 includes the first display line formed of the row electrodes $X_1$ and $Y_1$, the second display line formed of the row electrodes $X_2$ and $Y_2$, . . . , and the nth display line formed of the row electrodes $X_n$ and $Y_n$. Between these first to nth display lines and the column electrodes $Z_1$ to $Z_m$, a discharge gap is defined in which a discharge gas is sealed. At each portion of intersection of the row electrodes and the column electrodes including the discharge gap, there is also formed a pixel cell associated with a pixel.

The row electrode drive circuit 30 produces a reset pulse, a scan pulse, and a sustain pulse for application to the row electrodes $Y_1$ to $Y_n$ of the PDP 10 in response to a drive control signal supplied from a drive control circuit 150, to be discussed later. The reset pulse initializes the state of all the pixel cells. The scan pulse sequentially selects a display line on which pixel data is to be written. The sustain pulse allows a repetitive sustain discharge to occur only at a pixel cell having residual wall charges that is in an ON mode state. In response to a drive control signal supplied from the drive control circuit 150, the row electrode drive circuit 40 produces a reset pulse for initializing the state of all the pixel cells and a sustain pulse for allowing a repetitive sustain discharge to occur only at a pixel cell that is in an ON mode state. The row electrode drive circuit 40 then applies these pulses to the row electrodes $X_1$ to $X_n$ of the PDP 10.

A pixel data conversion circuit 100 supplies the pixel data PD, which is obtained by converting an input video signal to N-bit pixel data on a pixel-by-pixel basis, to a vertical frequency determination circuit 120 and the drive control circuit 150.

For each bit digit (the first to Nth bit) of the aforementioned N-bit pixel data PD, the vertical frequency determination circuit 120 determines whether a pixel data bit train has a frequency lower than a predetermined frequency in the vertical direction of the screen, to obtain a result of the determination (hereinafter referred to as the vertical frequency determination result). For example, suppose that in a bit train of n successive pixel data bits associated respectively with the first to nth display lines of each column, there is an interval in which some pixel data bits appear successively at the same logic level more often than a predetermined number of times (e.g., four times). In this case, the vertical frequency determination circuit 120 determines that in the interval, the pixel data bit train has a frequency lower than a predetermined frequency in the vertical direction of the screen. On the other hand, suppose that in a bit train of n successive pixel data bits associated respectively with the first to nth display lines of each column, some pixel data bits appear successively at the same logic level less often than a predetermined number of times (e.g., four times). In this case, the vertical frequency determination circuit 120 determines that in the interval, the pixel data bit train has a frequency higher than the predetermined frequency in the vertical direction of the screen. Then, the vertical frequency determination circuit 120 supplies, to the drive control circuit 150, vertical frequency determination signals $VD_1$ to $VD_N$ that each indicate the aforementioned vertical frequency determination result for each of the first to Nth bits as a vertical frequency determination result associated with each of sub-fields SF1 to SF(N), to be discussed later. For example, the vertical frequency determination circuit 120 produces the vertical frequency determination result at logic level "0" when a bit train including a first bit group of pixel data bits in the pixel data PD has a frequency lower than a predetermined frequency in the vertical direction of the screen. On the other hand, the circuit 120 produces the result at logic level "1" when the bit train has a frequency higher than the predetermined frequency. Here, the circuit 120 produces the vertical frequency determination result as the vertical frequency determination signal $VD_1$ associated with the sub-field SF1. To sum up, the vertical frequency determination circuit 120 determines whether the input video signal (the pixel data PD) has a frequency lower than a predetermined frequency in the vertical direction of the screen, and then supplies the result of the determination to the drive control circuit 150.

Figure 6:
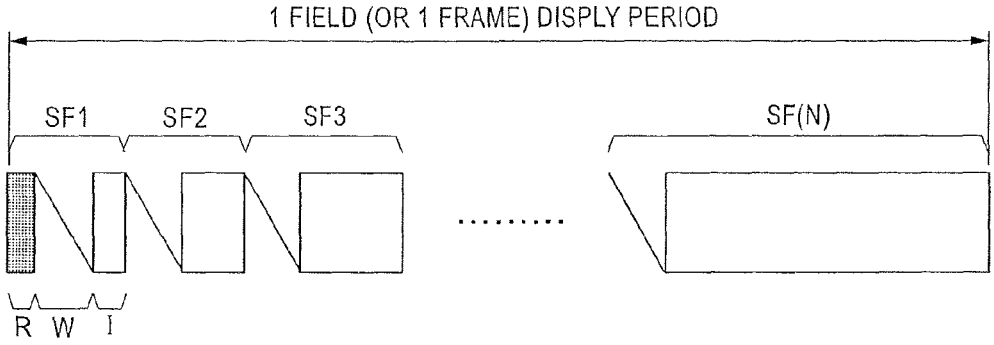
FIG. 6 is a view illustrating a light-emission drive sequence based on a sub-field method.

The drive control circuit 150 follows the light-emission drive sequence in accordance with the sub-field method shown in FIG. 6 to perform an address step W and a sustain step I in each of the N sub-fields SF1 to SF(N) during each unit display period (one field or one frame display period). At this time, the drive control circuit 150 separates each one field (or one frame) of pixel data PD by bit digit. The circuit 150 then assigns a first bit digit group of pixel data bits to the sub-field SF1, a second bit digit group of pixel data bits to the sub-field SF2, a third bit digit group of pixel data bits to the sub-field SF3, . . . , and an nth bit digit group of pixel data bits to the sub-field SF(N). Here, in the address step W of each sub-field, the drive control circuit 150 extracts one display line of (m) pixel data bits line by line sequentially across the first to nth display lines from the group of pixel data bits assigned to each sub-field. Then, the circuit 150 supplies the resulting each display line of (m) pixel data bits as the pixel data bits $DB_1$ to $DB_m$ to a column electrode drive circuit 200. Meanwhile, the drive control circuit 150 supplies, to the row electrode drive circuit 30, a drive control signal for sequentially applying the aforementioned scan pulse to the row electrodes $Y_1$ to $Y_n$ in synchronism with the application timing of the pixel data bit DB to each display line. Meanwhile, the circuit 150 also supplies, to the column electrode drive circuit 200, the switching signals SW1 to SW3 for providing ON/OFF control to the switching elements according to the sequence shown in FIG. 3.

Furthermore, in the address step W of SFk (K: 1 to N) of the sub-fields SF1 to SF(N), the drive control circuit 150 produces a drive mode designation signal GS, in accordance with the vertical frequency determination result indicated by a vertical frequency determination signal VDk, for supply to the column electrode drive circuit 200. That is, suppose that the vertical frequency determination result indicated by the vertical frequency determination signal VDk is at logic level "1," i.e., the group of pixel data bits has a frequency higher than a predetermined frequency in the vertical direction of the screen. In this case, the drive control circuit 150 supplies, to the column electrode drive circuit 200, the drive mode designation signal GS at logic level "1" for specifying a high drive mode. On the other hand, when such a group of pixel data bits has a frequency lower than the predetermined frequency in the vertical direction of the screen, the drive control circuit 150 supplies, to the column electrode drive circuit 200, the drive mode designation signal GS at logic level "0" for specifying a low drive mode.

The column electrode drive circuit 200 allows m pixel data pulses each having a pulsed voltage associated with each logic level of the pixel data bits $DB_1$ to $DB_m$ supplied from the drive control circuit 150 to be produced and applied to column electrodes $D_1$ to $D_m$, respectively. That is, in the address step W of each sub-field shown in FIG. 6, the column electrode drive circuit 200 first applies m pixel data pulses associated with the first display line to the column electrodes $D_1$ to $D_m$, respectively. The circuit 200 then applies m pixel data pulses associated with the second display line to the column electrodes $D_1$ to $D_m$, respectively. Subsequently in the same manner, the column electrode drive circuit 200 applies one display line of (m) pixel data pulses associated with each of the third to nth display lines sequentially to the column electrodes $D_1$ to $D_m$. At this time, an address discharge occurs only in the pixel cell located at the portion of intersection of a display line to which the aforementioned scan pulse is applied and a column electrode to which a high voltage pixel data pulse is applied. It is thus allowed to build wall charges in the pixel cell (or to erase residual wall charges). On the other hand, in a pixel cell to which a low voltage pixel data pulse is applied at the same time as the scan pulse, no address discharge occurs, allowing the immediately preceding wall charge state to be maintained. That is, in the address step W, the so-called pixel data writing is performed by allowing each pixel cell to selectively discharge in accordance with pixel data. Here, each pixel cell is sequentially set on each display line basis to either an ON mode state in which wall charge is present or an OFF mode state in which no wall charge is present.

Figure 7:
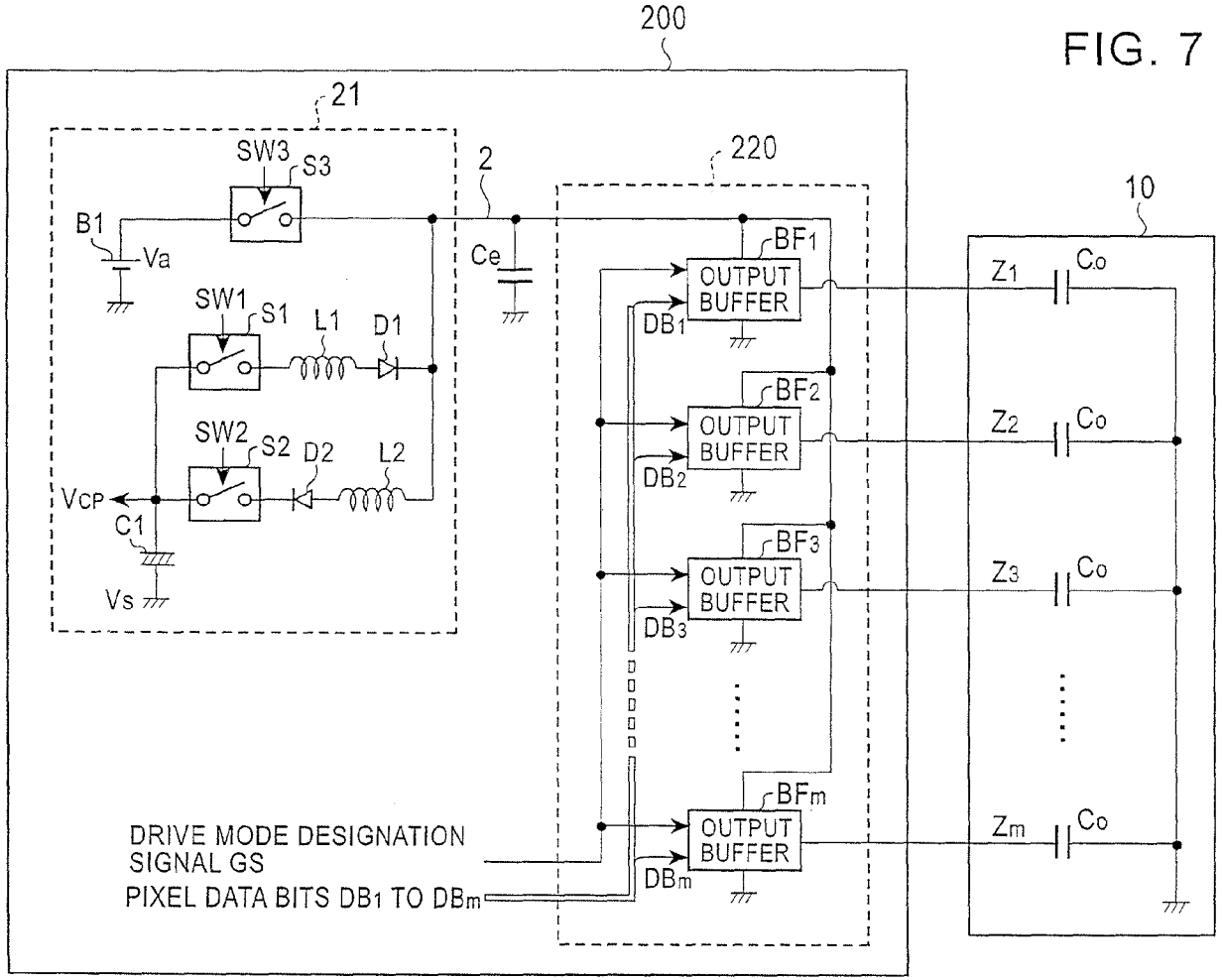
FIG. 7 is a view illustrating an exemplary internal configuration of a column electrode drive circuit 200 shown in FIG. 5.

FIG. 7 is a view illustrating the internal configuration of such a column electrode drive circuit 200.

In FIG. 7, the column electrode drive circuit 200 includes the power supply circuit 21 and the pixel data pulse generation circuit 220.

In the power supply circuit 21, the capacitor C1 has one end connected to a ground line that is set at the ground potential of the PDP 10 or a PDP ground potential Vs. The switching element S1 is in an OFF state while being supplied by the aforementioned drive control circuit 150 with the switching signal SW1 at logic level "0." On the other hand, when such a switching signal SW1 is at logic level "1," the switching element S1 is turned ON to apply a voltage appearing at the other end of the aforementioned capacitor C1 to the power supply line 2 via the coil L1 and the diode D1. This causes the capacitor C1 to start discharging, and the voltage resulting from the discharge to be applied to the power supply line 2. The switching element S2 is in an OFF state while being supplied by the aforementioned drive control circuit 150 with the switching signal SW2 at logic level "0." However, the switching element S2 is turned ON when the switching signal SW2 is at logic level "1," thereby causing the voltage on the aforementioned power supply line 2 to be applied to the other end of the aforementioned capacitor C1 via the coil L2 and the diode D2. At this time, the capacitor C1 is charged by the aforementioned voltage on the power supply line 2. The switching element S3 is in an OFF state while being supplied by the drive control circuit 150 with the aforementioned switching signal SW3 at logic level "0." However, the switching element S3 is turned ON when the switching signal SW3 is at logic level "1," thereby causing the voltage Va produced by the DC power supply B1 to be applied to the power supply line 2. Note that the negative terminal of the DC power supply B1 is connected to a ground line that is set at the aforementioned ground potential Vs of the PDP.

Figure 1:
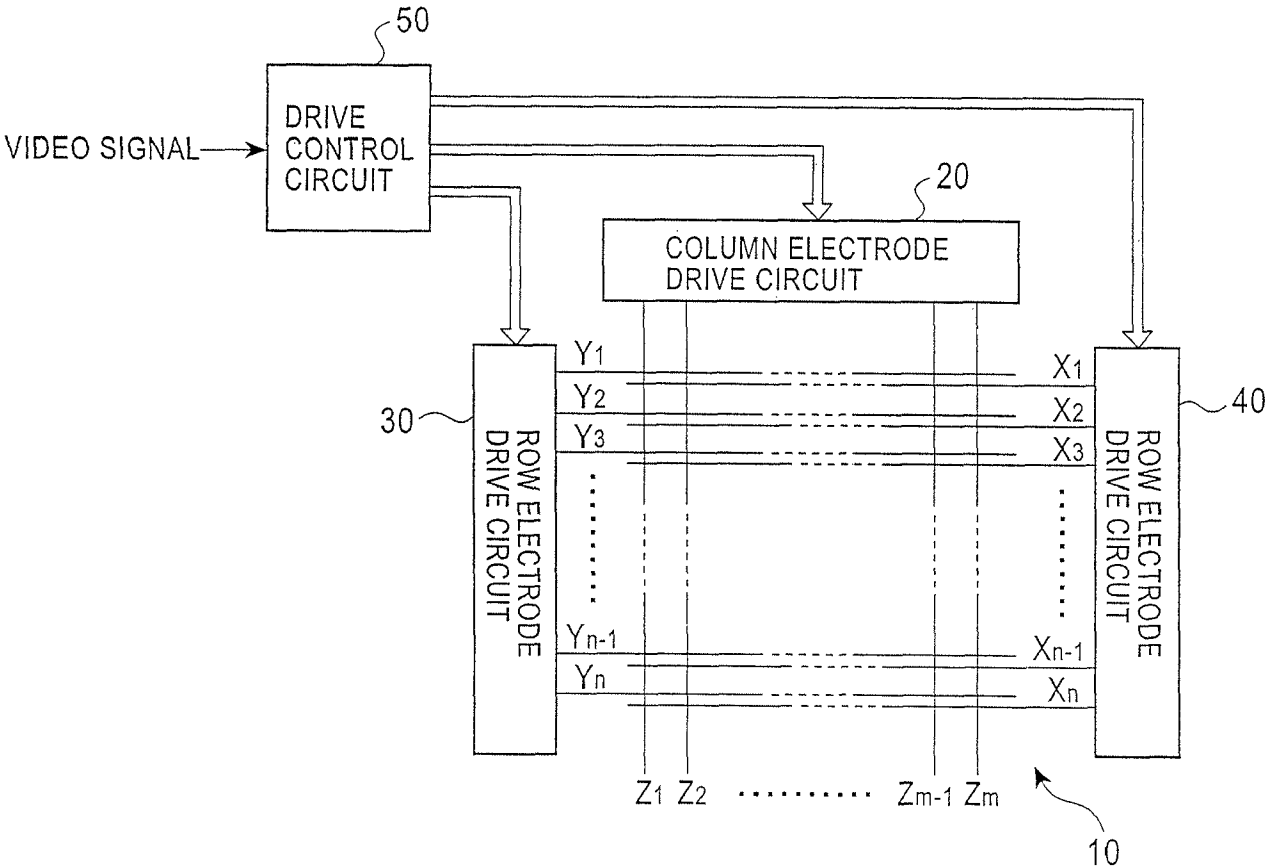
FIG. 1 PRIOR ART
FIG. 1 is a view schematically illustrating the configuration of a plasma display device.
Figure 2:
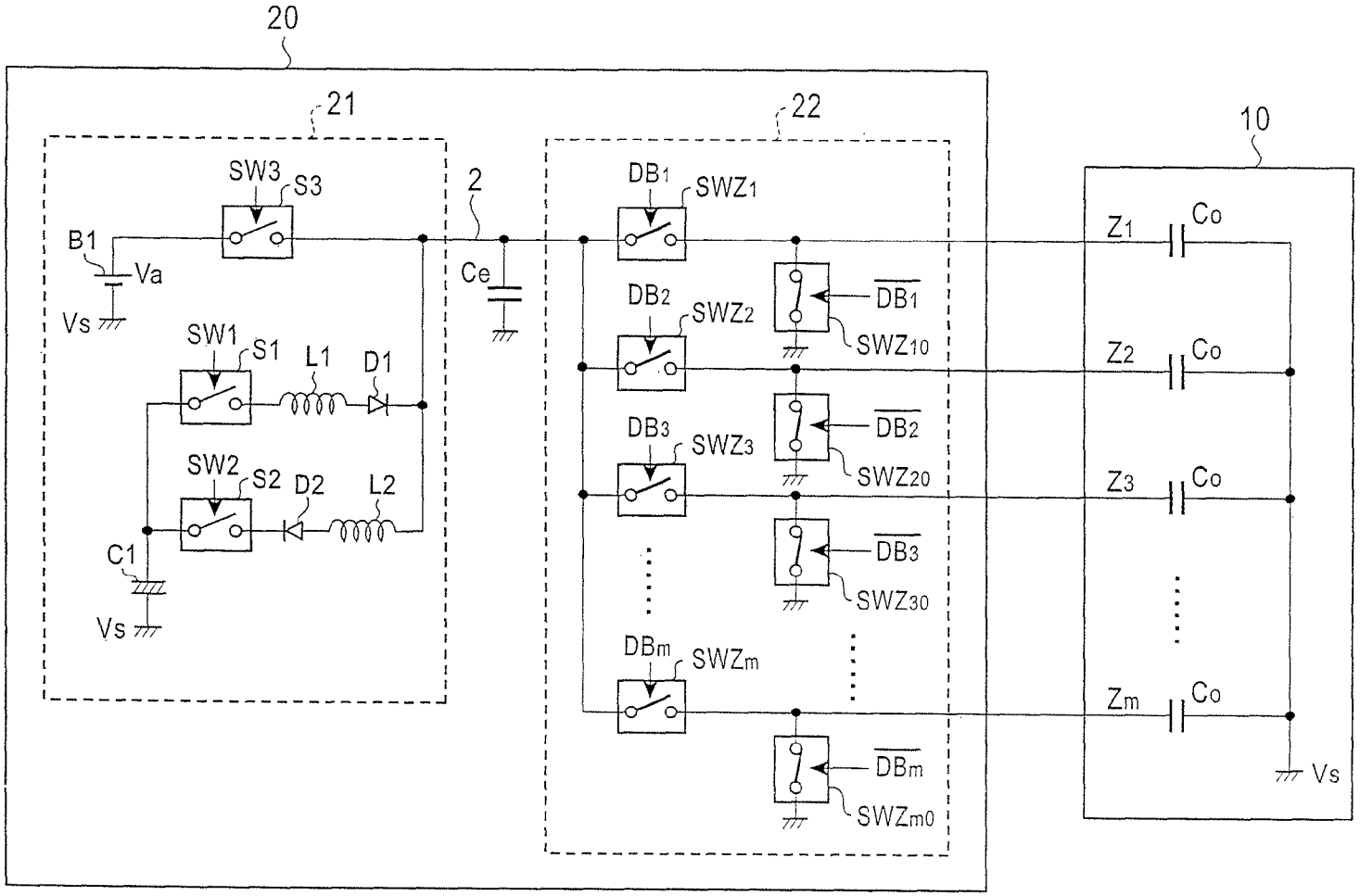
FIG. 2 PRIOR ART
FIG. 2 is a view illustrating an exemplary internal configuration of the column electrode drive circuit 20 shown in FIG. 1.
Figure 3:
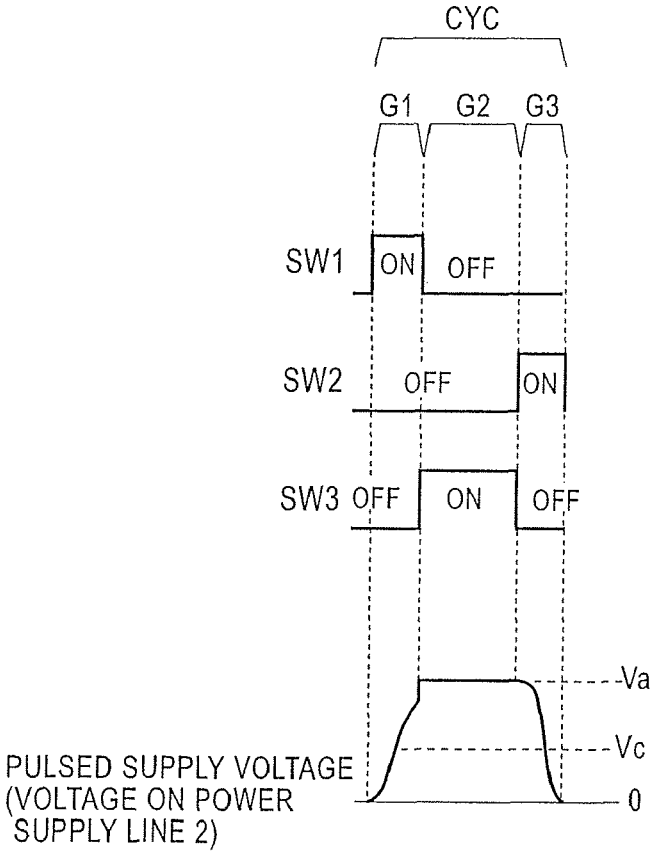
FIG. 3 PRIOR ART
FIG. 3 is a view illustrating the waveform of a pulsed supply voltage produced on the power supply line 2.
Figure 4:
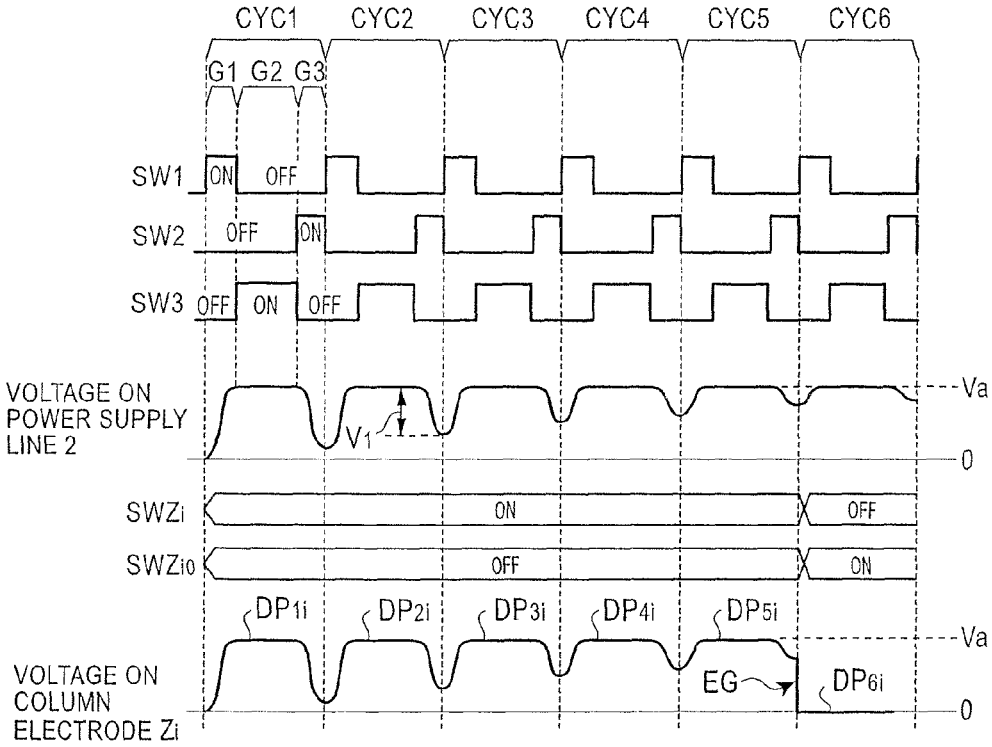
FIG. 4 PRIOR ART
FIG. 4 is a view illustrating an exemplary waveform of a pixel data pulse applied to a column electrode Z by the column electrode drive circuit 20 shown in FIG. 1.

As shown in FIG. 3, the power supply circuit 21 produces a pulsed supply voltage having the peak voltage Va for application to the power supply line 2. This is done in response to the switching signals SW1 to SW3 for providing ON/OFF control to the switching elements S1 to S3 through the sequence of the drive steps G1 to G3 in each pixel data cycle CYC. Suppose that the aforementioned pixel data bits have a lower frequency in the vertical direction of the screen, i.e., a larger number of successive pixel data bits associated respectively with a pixel cell that belongs to each of adjacent display lines are at the same logic level on each column electrode. In this case, the power supply circuit 21 reduces the pulsed supply voltage more in amplitude while being maintained at the peak voltage Va.

The pixel data pulse generation circuit 220 includes output buffers $BF_1$ to $BF_m$ for individually producing pixel data pulses in accordance with the pixel data bits $DB_1$ to $DB_m$ supplied from the drive control circuit 150 and supplying the resulting pulses to the column electrodes $Z_1$ to $Z_m$ of the PDP 10, respectively. For example, the output buffer $BF_1$ applies a pixel data pulse at the low voltage (the PDP ground potential Vs) to the column electrode $Z_1$ when the pixel data bit $DB_1$ is at logic level "1." On the other hand, when the pixel data bit $DB_1$ is at logic level "0," the output buffer $BF_1$ applies a so-called high voltage pixel data pulse or the pixel data pulse having the pulsed supply voltage of the power supply line 2 to the column electrode $Z_1$. Further, the output buffer $BF_2$ applies the low voltage (the PDP ground potential Vs) pixel data pulse to the column electrode $Z_2$ when the pixel data bit $DB_2$ is at logic level "1." On the other hand, when the pixel data bit $DB_2$ is at logic level "0," the output buffer $BF_2$ applies a so-called high voltage pixel data pulse having the pulsed supply voltage to the column electrode $Z_2$.

Note that each of the output buffers $BF_1$ to $BF_m$ is provided with a current drive capability (a low drive mode or a high drive mode) that is set at the time of application of the aforementioned low voltage pixel data pulse in response to the drive mode designation signal GS supplied from the drive control circuit 150.

Figure 8:
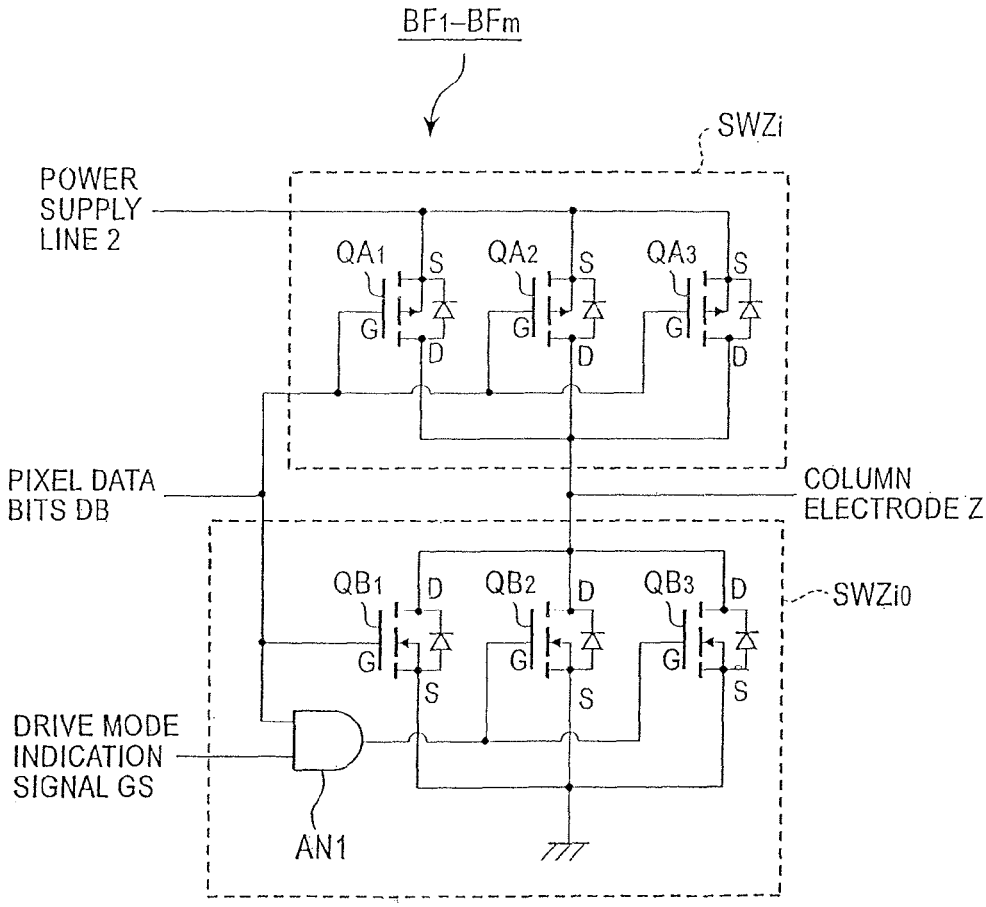
FIG. 8 is a view illustrating an exemplary internal configuration of each of output buffers $BF_1$ to $BF_m$ shown in FIG. 7.

FIG. 8 is a view illustrating an exemplary internal configuration of each of the output buffers $BF_1$ to $BF_m$.

As shown in FIG. 8, each of the output buffers $BF_1$ to $BF_m$ is made up of switch units SWZi and $SWZ_{i0}$.

The switch unit SWZi includes p-channel type MOS transistors $QA_1$ to $QA_3$ each having a source terminal S connected in common to the aforementioned power supply line 2 and a drain terminal D connected in common to one column electrode Z. The gate terminal G of each of these transistors $QA_1$ to $QA_3$ is supplied in common with a voltage associated with the logic level of the pixel data bit DB supplied from the drive control circuit 150. Each of the transistors $QA_1$ to $QA_3$ is simultaneously turned OFF when the pixel data bit DB is at logic level "1," but on the other hand, is simultaneously turned ON when the pixel data bit DB is at logic level "0," thereby applying the voltage of the power supply line 2 to the column electrode Z. At this time, each of the transistors $QA_1$ to $QA_3$ has the same current drive capability. That is, the switch unit SWZi has a current drive capability of supplying, to the column electrode Z, a current three times lager than in the case of a single transistor QA.

On the other hand, the switch unit $SWZ_{i0}$ includes n-channel type MOS transistors $QB_1$ to $QB_3$ each having a drain terminal D connected in common to the column electrode Z and a source terminal S connected to a ground line, and an AND circuit AN1. The gate terminal G of the transistor $QB_1$ is supplied with a voltage associated with the logic level of the pixel data bit DB supplied from the drive control circuit 150. Accordingly, the transistor $QB_1$ is turned OFF when the pixel data bit DB is at logic level "0." However, the transistor $QB_1$ is turned ON when the pixel data bit DB is at logic level "1," thereby connecting the column electrode Z to the ground line.

On the other hand, the gate terminal G of each of the transistors $QB_2$ and $QB_3$ is applied with a voltage delivered from the AND circuit AN1. At this time, when the aforementioned drive mode designation signal GS is at logic level "1," the AND circuit AN1 supplies a voltage associated with the logic level of the pixel data bit DB to each gate terminal G of the transistors $QB_2$ and $QB_3$. On the other hand, when the drive mode designation signal GS is at logic level "0," the AND circuit AN1 supplies a voltage associated with the logic level "0" to each gate terminal G of the transistors $QB_2$ and $QB_3$ irrespective of the logic level of the aforementioned pixel data bit DB.

That is, when supplied with the drive mode designation signal GS at logic level "1," the switch unit $SWZ_{i0}$ is set to the high drive mode in which all the transistors $QB_1$ to $QB_3$ are capable of switching operation. In the high drive mode, the switch unit $SWZ_{i0}$ in its ON state allows all the transistors $QB_1$ to $QB_3$ to be turned ON. Accordingly, a current caused by the charges stored on the load capacitance $C_0$ of the PDP 10 flows to the ground line via each of the three transistors $QB_1$ to $QB_3$ to be consumed. Accordingly, since the switch unit $SWZ_{i0}$ allows a relatively large current to flow to the ground line in the high drive mode, the voltage on the column electrode Z goes immediately to the ground potential (0 volt).

On the other hand, when the drive mode designation signal GS is supplied at logic level "0," the switch unit $SWZ_{i0}$ is set to the low drive mode in which only the $QB_1$ of the transistors $QB_1$ to $QB_3$ is capable of switching operation. Accordingly, in the low drive mode, the switch unit $SWZ_{i0}$ in its ON state allows only the transistor $QB_1$ to be turned ON. Accordingly, a current caused by the charges stored on the load capacitance $C_0$ of the PDP 10 flows to the ground line only via the transistor $QB_1$ to be consumed. That is, the switch unit $SWZ_{i0}$ allows a smaller amount of current to flow to the ground line in the low drive mode, thereby causing the voltage on the column electrode Z to more gradually go to the ground potential (0 volt) than during operation in the high drive mode.

As described above, each of the output buffers $BF_1$ to $BF_m$ is adapted to change the current drive capability (the low drive mode and the high drive mode) of the $SWZ_{i0}$ of the switch units SWZi and $SWZ_{i0}$ in response to the drive mode designation signal GS. That is, suppose that the input video signal (the pixel data bits DB) has a lower frequency in the vertical direction of the screen. In this case, when compared with a case of the input video signal having a higher frequency, the switch unit $SWZ_{i0}$ can change its current drive capability to allow a less amount of current to flow to the ground line when the column electrode Z is connected thereto.

Now, a description will be made to the operation of the column electrode drive circuit 200 shown in FIG. 7 and FIG. 8 with reference to FIGS. 9 and 10.

Figure 9:
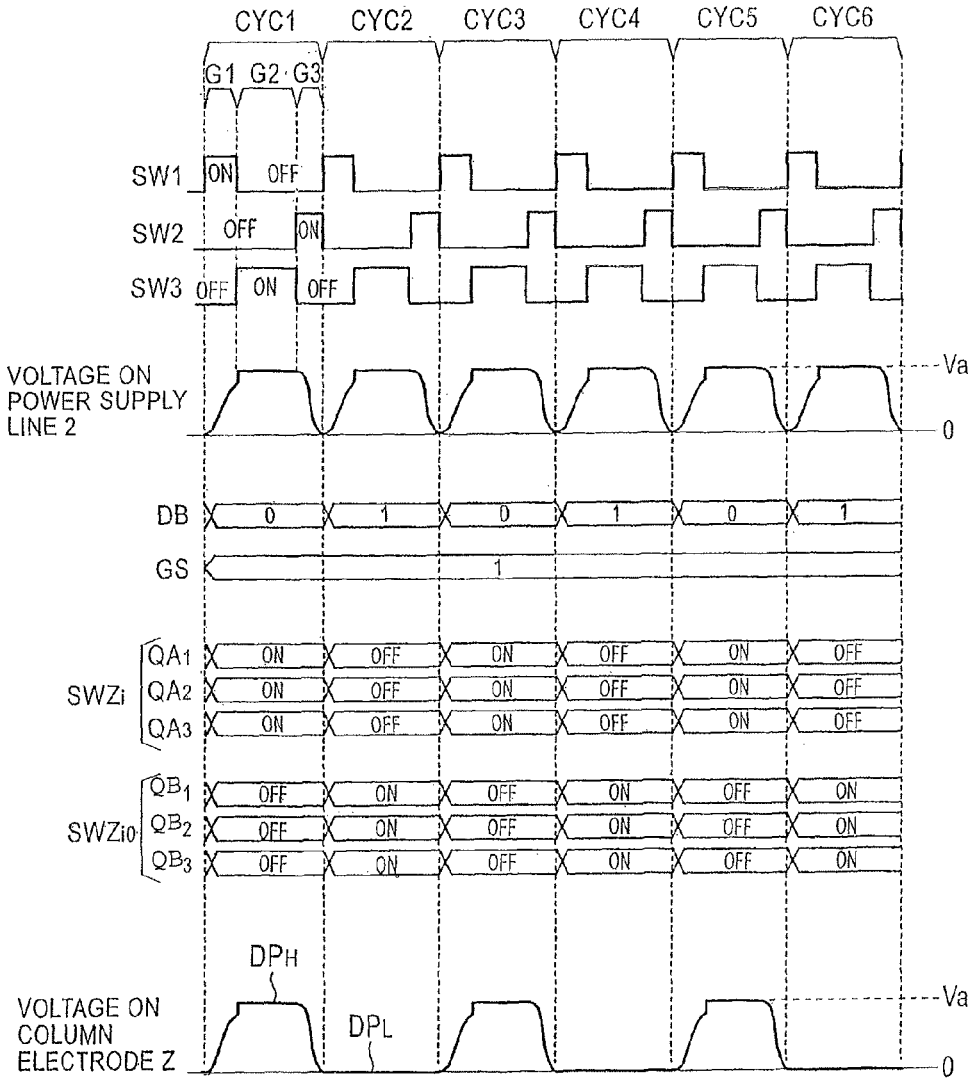
FIG. 9 is a view illustrating the internal operation of the power supply circuit 21 and each output buffer BF when an input video signal has a higher frequency in the vertical direction of the screen.
Figure 10:
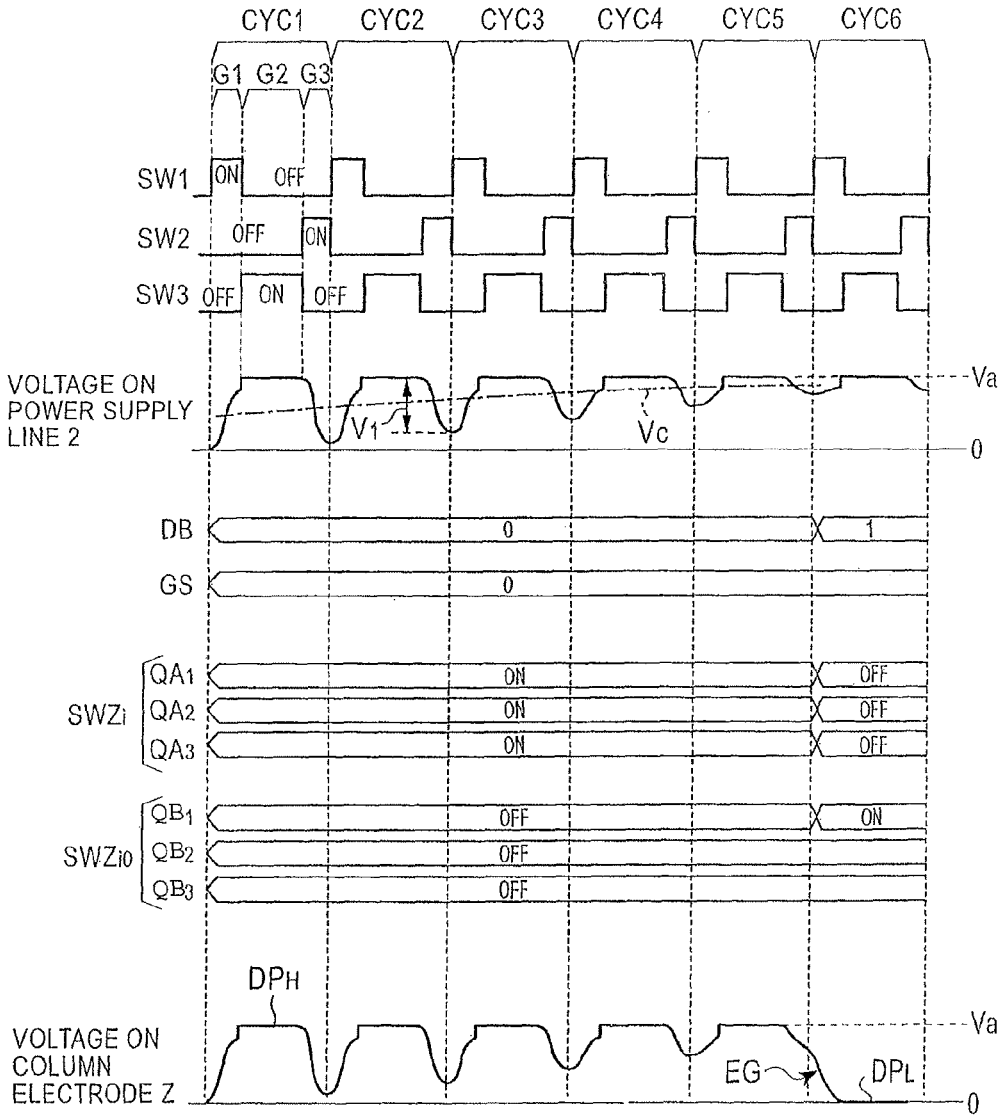
FIG. 10 is a view illustrating the internal operation of the power supply circuit 21 and each output buffer BF when an input video signal has a lower frequency in the vertical direction of the screen.

Note that FIG. 9 illustrates the operation performed when the pixel data bit DB has a frequency higher than a predetermined frequency in the vertical direction of the screen, whereas FIG. 10 illustrates the operation performed when the pixel data bit DB has a frequency lower than the predetermined frequency in the vertical direction of the screen. Furthermore, FIGS. 9 and 10 both extract and show only the column electrode Z1 of the column electrodes $Z_1$ to $Z_m$, illustrating changes in the voltage on the column electrode Z, changes in the voltage on the power supply line 2, and the internal operation of each of the switch units SWZi and $SWZ_{i0}$ in the output buffer $BF_1$.

Suppose that the column electrode drive circuit 200 is supplied with [1, 0, 1, 0, 1, 0], shown in FIG. 9, as a train of pixel data bits DB which has a high frequency in the vertical direction of the screen. In this case, the drive control circuit 150 first supplies, to the column electrode drive circuit 200, the drive mode designation signal GS at logic level "1" for specifying the high drive mode. That is, at this time, in the train of pixel data bits DB, the number of successive occurrences of the same logic level is one, which is less than a predetermined number of times of four. Thus, the drive control circuit 150 supplies the drive mode designation signal GS for specifying the high drive mode to the column electrode drive circuit 200. In response to such a drive mode designation signal GS, all the transistors $QB_1$ to $QB_3$ of the switch unit $SWZ_{i0}$ in an output buffer BF shown in FIG. 8 become activated, thereby allowing the switch unit $SWZ_{i0}$ to go into the high drive mode. A consideration is now given to each of the pixel data cycles CYC1 to CYC6 or the application cycles of each pixel data bit DB shown in FIG. 9. During each of the cycles, the drive control circuit 150 supplies, to the column electrode drive circuit 200, the switching signals SW1 to SW3 to provide ON/OFF control to the switching elements S1 to S3 of the power supply circuit 21 in the sequence of the drive steps G1 to G3.

Here, in each of the pixel data cycles CYC1, CYC3, and CYC5 of FIG. 9, all the transistors $QA_1$ to $QA_3$ of the switch unit SWZi in an output buffer BF are turned ON at the same time in accordance with the pixel data bit DB at logic level "0." Accordingly, suppose that in each of the pixel data cycles CYC1, CYC3, and CYC5, the switching element S1 of the power supply circuit 21 is turned ON in the drive step G1. In this case, the charges stored on the capacitor C1 are discharged, thereby allowing the discharge current to flow into the column electrode Z of the PDP 10 via the switching element S1, the coil L1, the diode D1, the power supply line 2, and each of the transistors $QA_1$ to $QA_3$ of the output buffer BF. This in turn causes the parasitic load capacitance $C_0$ of the column electrode Z to be charged, thereby allowing charges to be stored on the load capacitance $C_0$. At this time, the resonance effect of the coil L1 and the load capacitance $C_0$ causes gradual increases in the voltage of the power supply line 2, with this interval of increase in voltage serving as the rising edge portion of the pulsed supply voltage. Then, when the switching element S3 is turned ON in the drive step G2, the voltage Va from the power supply B1 is applied to the column electrode Z of the PDP 10 via the switching element S3, the power supply line 2, and each of the transistors $QA_1$ to $QA_3$ of the output buffer BF. At this time, the voltage Va applied to the power supply line 2 becomes the peak voltage of the pulsed supply voltage. Note that such a voltage application allows charges to be stored on each of a parasitic capacitance Ce on the power supply line 2 and the parasitic load capacitance $C_0$ on the column electrode Z. Then, when the switching element S2 is turned ON in the drive step G3, the load capacitance $C_0$ of the PDP 10 starts to discharge. The discharge current then flows into the capacitor C1 via the column electrode Z, the transistors $QA_1$ to $QA_3$ of the output buffer BF, the power supply line 2, the coil L2, the diode D2, and the switching element S2 to thereby charge the capacitor C1. That is, the charge stored on the load capacitance $C_0$ of the PDP 10 is transferred back to the capacitor C1. At this time, the time constant defined by the coil L2 and the load capacitance $C_0$ causes a gradual decrease in the voltage on the power supply line 2 and the column electrode Z. Such an interval of decrease in voltage becomes the falling edge portion of the pulsed supply voltage.

Accordingly, in each of the pixel data cycles CYC1, CYC3, and CYC5 of FIG. 9, a high voltage pixel data pulse $DP_H$ based on the pulsed supply voltage appearing on the power supply line 2 is applied to the column electrode Z in accordance with the pixel data bit DB at logic level "0."

On the other hand, in each of the pixel data cycles CYC2, CYC4, and CYC6 shown in FIG. 9, all the transistors $QB_1$ to $QB_3$ of the switch unit $SWZ_{i0}$ are turned ON at the same time in accordance with the pixel data bit DB at logic level "1." Accordingly, in each of these pixel data cycle CYC2, CYC3, and CYC5, the pulsed supply voltage is produced on the power supply line 2 as shown in FIG. 9 but the column electrode Z is set at the ground potential (0 volt). Thus, a low voltage pixel data pulse DPL is applied to the column electrode Z as shown in FIG. 9. Note that the column electrode Z is limited to the ground potential (0 volt), thereby allowing a current caused by the charges stored on the load capacitance $C_0$ of the PDP 10 to flow into each of the transistors $QB_1$ to $QB_3$ of the switch unit $SWZ_{i0}$ to be consumed.

Then, suppose that the column electrode drive circuit 200 is supplied with [1, 1, 1, 1, 1, 0], shown in FIG. 10, as a train of pixel data bits DB which has a low frequency in the vertical direction of the screen. In this case, the drive control circuit 150 supplies, to the column electrode drive circuit 200, the drive mode designation signal GS at logic level "0" for specifying the low drive mode. That is, at this time, in the train of the pixel data bits DB, the number of successive occurrences of the logic level "1" is five, which is greater than the predetermined number of times of four. Thus, the drive control circuit 150 supplies the drive mode designation signal GS for specifying the low drive mode to the column electrode drive circuit 200. In response to such a drive mode designation signal GS, the $QB_2$ and $QB_3$ of the transistors $QB_1$ to $QB_3$ of the switch unit $SWZ_{i0}$ in an output buffer BF shown in FIG. 8 become fixed in an OFF state or inactivated. That is, at this time, the switch unit $SWZ_{i0}$ in its ON state goes into the low drive mode in which only the $QB_1$ of the transistors $QB_1$ to $QB_3$ outputs current. A consideration is also given to each of the pixel data cycles CYC1 to CYC6 or the application cycles of each pixel data bit DB shown in FIG. 10. In this case, during each cycle, the drive control circuit 150 supplies, to the column electrode drive circuit 200, the switching signals SW1 to SW3 to provide ON/OFF control to the switching elements S1 to S3 of the power supply circuit 21 in the sequence of the drive steps G1 to G3.

Here, in each of the pixel data cycles CYC1 to CYC5 of FIG. 10, all the transistors $QA_1$ to $QA_3$ of the switch unit SWZi are turned ON at the same time in accordance with the pixel data bit DB at logic level "0." Accordingly, suppose that in each of the pixel data cycles CYC1 to CYC5, the switching element S1 of the power supply circuit 21 is turned ON in the drive step G1. In this case, the charges stored on the capacitor C1 are discharged, thereby allowing the discharge current to flow into the column electrode Z of the PDP 10 via the switching element S1, the coil L1, the diode D1, the power supply line 2, and each of the transistors $QA_1$ to $QA_3$ of the output buffer BF. This in turn allows for charging the parasitic load capacitance $C_0$ on the column electrode Z, thereby allowing charges to be stored on the load capacitance $C_0$. At this time, the resonance effect of the coil L1 and the load capacitance $C_0$ causes gradual increases in the voltage on the power supply line 2, with this interval of increase in voltage serving as the rising edge portion of the pulsed supply voltage. Then, when the switching element S3 is turned ON in the drive step G2, the voltage Va from the power supply B1 is applied to the column electrode Z of the PDP 10 via the switching element S3, the power supply line 2, and each of the transistors $QA_1$ to $QA_3$ of the output buffer BF. At this time, the voltage Va applied to the power supply line 2 is at the peak voltage of the pulsed supply voltage. Note that such a voltage application allows charges to be stored on each of the parasitic capacitance Ce on the power supply line 2 and the parasitic load capacitance $C_0$ on the column electrode Z. Then, suppose that when the switching element S2 is turned ON in the drive step G3, the load capacitance $C_0$ of the PDP 10 starts to discharge. In this case, the discharge current flows into the capacitor C1 via the column electrode Z, the transistors $QA_1$ to $QA_3$ of the output buffer BF, the power supply line 2, the coil L2, the diode D2, and the switching element S2 to thereby charge the capacitor C1. That is, the charges stored on the load capacitance $C_0$ of the PDP 10 are transferred back to the capacitor C1. At this time, the time constant defined by the coil L2 and the load capacitance $C_0$ causes the voltage on the power supply line 2 and the column electrode Z to decrease gradually. However, suppose that the pixel data bits DB are successively at logic level "1" across the pixel data cycles CYC1 to CYC5 as shown in FIG. 10. In this case, the transistor $QB_1$ of the switching unit $SWZ_{i0}$ is never turned ON during these cycles, and thus the charge stored on the load capacitance $C_0$ of the PDP 10 will never be consumed. Accordingly, those charges caused by the voltage Va applied to the power supply line 2 in the drive step G2 of each of the pixel data cycles CYC1 to CYC5 are gradually stored on each of the capacitance Ce on the power supply line 2 and the load capacitance $C_0$ of the PDP 10. Accordingly, in the drive step G3, even when such a drive is carried out as to transfer the charges stored on each of the capacitance Ce on the power supply line 2 and the load capacitance $C_0$ of the PDP 10 back to the capacitor C1, the capacitor C1 cannot collect the charges. Accordingly, as shown in FIG. 10, the pulsed supply voltage applied to the power supply line 2 is gradually reduced in its resonance amplitude $V_1$ while being maintained at its peak voltage Va. Thus, the charge/discharge operations that would be otherwise caused by the aforementioned resonance effect will not occur, thereby suppressing reactive power.

Then, in the pixel data cycle CYC6, the switch unit $SWZ_{i0}$ of the output buffer BF is turned ON in accordance with the pixel data bit DB at logic level "1." This allows a current caused by the charges stored on the load capacitance $C_0$ of the PDP 10 to flow into the switch unit $SWZ_{i0}$ via the column electrode Z to be consumed, resulting in the voltage on the column electrode Z going to the ground potential (0 volt). At this time, since the switch unit $SWZ_{i0}$ is in the low drive mode, the current caused by the charges stored on the load capacitance $C_0$ of the PDP 10 flows only into the $QB_1$ of the transistors $QB_1$ to $QB_3$ to be consumed.

Accordingly, as shown with EG in FIG. 10, the voltage on the column electrode Z goes to the ground potential (O volt) more gradually than in the high drive mode in which current flows through all the transistors $QB_1$ to $QB_3$. This allows for reducing noise caused otherwise by the variation in voltage when compared with a case where the voltage on the column electrode Z suddenly changes from a high voltage to a low voltage (0 volt).

Figure 11:
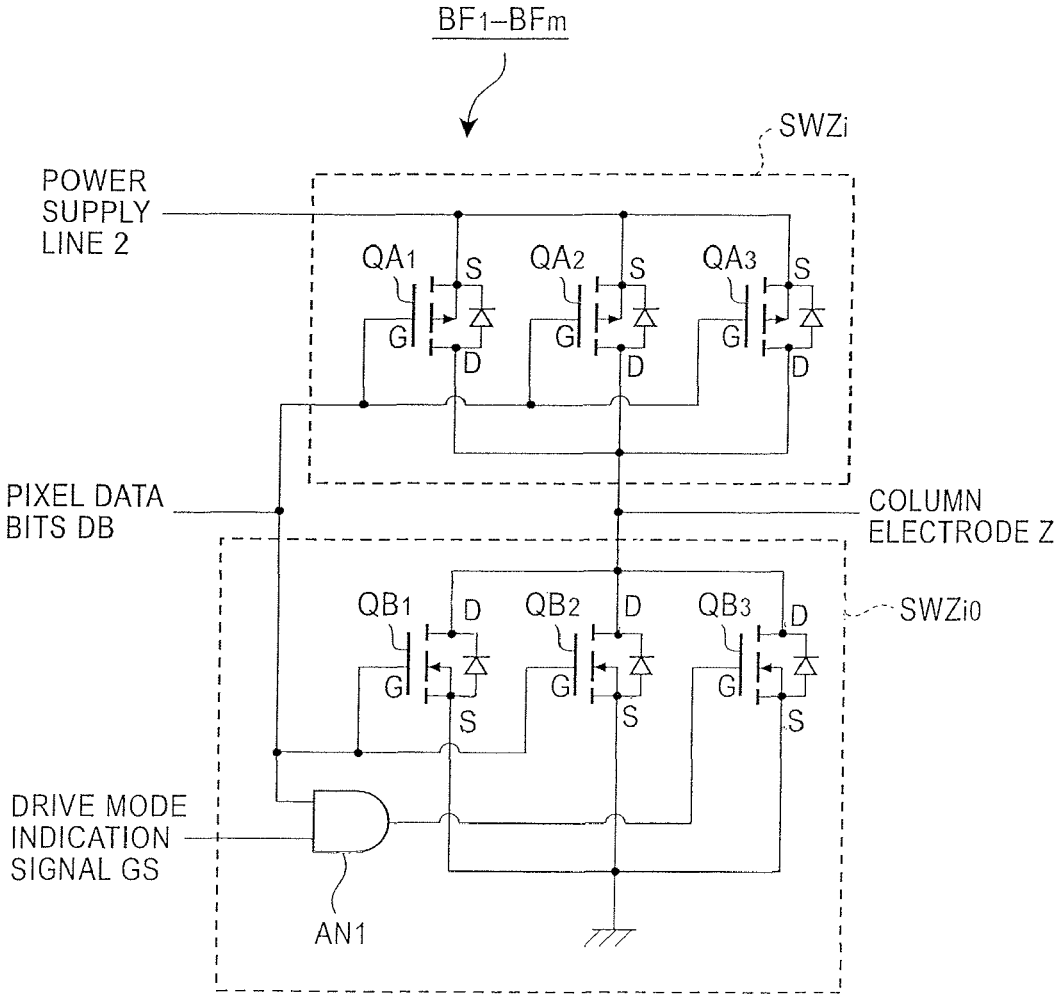
FIG. 11 is a view illustrating another exemplary internal configuration of each of the output buffers $BF_1$ to $BF_m$ shown in FIG. 7.

Note that in the aforementioned embodiment, the switch unit $SWZ_{i0}$ of the output buffer BF activates only the $QB_1$ of the transistors $QB_1$ to $QB_3$ in the low drive mode; however, the $QB_1$ and $QB_2$ may also be activated. FIG. 11 is a view illustrating another exemplary internal configuration of each of the output buffers $BF_1$ to $BF_m$ that have been developed from that point of view.

With reference to FIG. 11, this example is the same as the one shown in FIG. 8 in that the switch unit SWZi is made up of the transistors $QA_1$ to $QA_3$, and the switch unit $SWZ_{i0}$ is made up of the transistors $QB_1$ to $QB_3$, and the AND circuit AN1. However, in the configuration shown in FIG. 11, the AND circuit 1 of the switch unit $SWZ_{i0}$ is supposed to supply its output signal only to the gate terminal of $QB_3$ of the transistors $QB_1$ to $QB_3$. That is, in FIG. 11, the AND circuit AN1 inactivates the switching operation of only the $QB_3$ of the transistors $QB_1$ to $QB_3$ in response to the drive mode designation signal GS at logic level "0" indicative of the low drive mode. That is, in the low drive mode, the switch unit $SWZ_{i0}$ activates the switching operation of the $QB_1$ and $QB_2$ of the transistors $QB_1$ to $QB_3$.

Furthermore, in the aforementioned embodiment, the determination on whether the input video signal (the pixel data bits DB) has a frequency lower than a predetermined frequency in the vertical direction of the screen is made using the train of the pixel data bits DB itself; however, other methods may also employed.

For example, it is determined whether the input video signal has a frequency lower than a predetermined frequency in the vertical direction of the screen. This determination is made in accordance with a central voltage Vc of the resonance amplitude $V_1$ of the pulsed supply voltage, shown in FIG. 10 (indicated by alternate long and short dashed lines), produced on the power supply line 2. That is, suppose that the input video signal has a lower frequency in the vertical direction of the screen, i.e., the pixel data bit DB train has a less number of times of changes in logic level per unit time. In this case, as shown in FIG. 10 (indicated by alternate long and short dashed lines), the central voltage Vc of the resonance amplitude $V_1$ of the pulsed supply voltage is raised. Thus, when the central voltage Vc is higher than a predetermined voltage, it is determined that the input video signal has a frequency lower than a predetermined frequency in the vertical direction of the screen.

Figure 12:
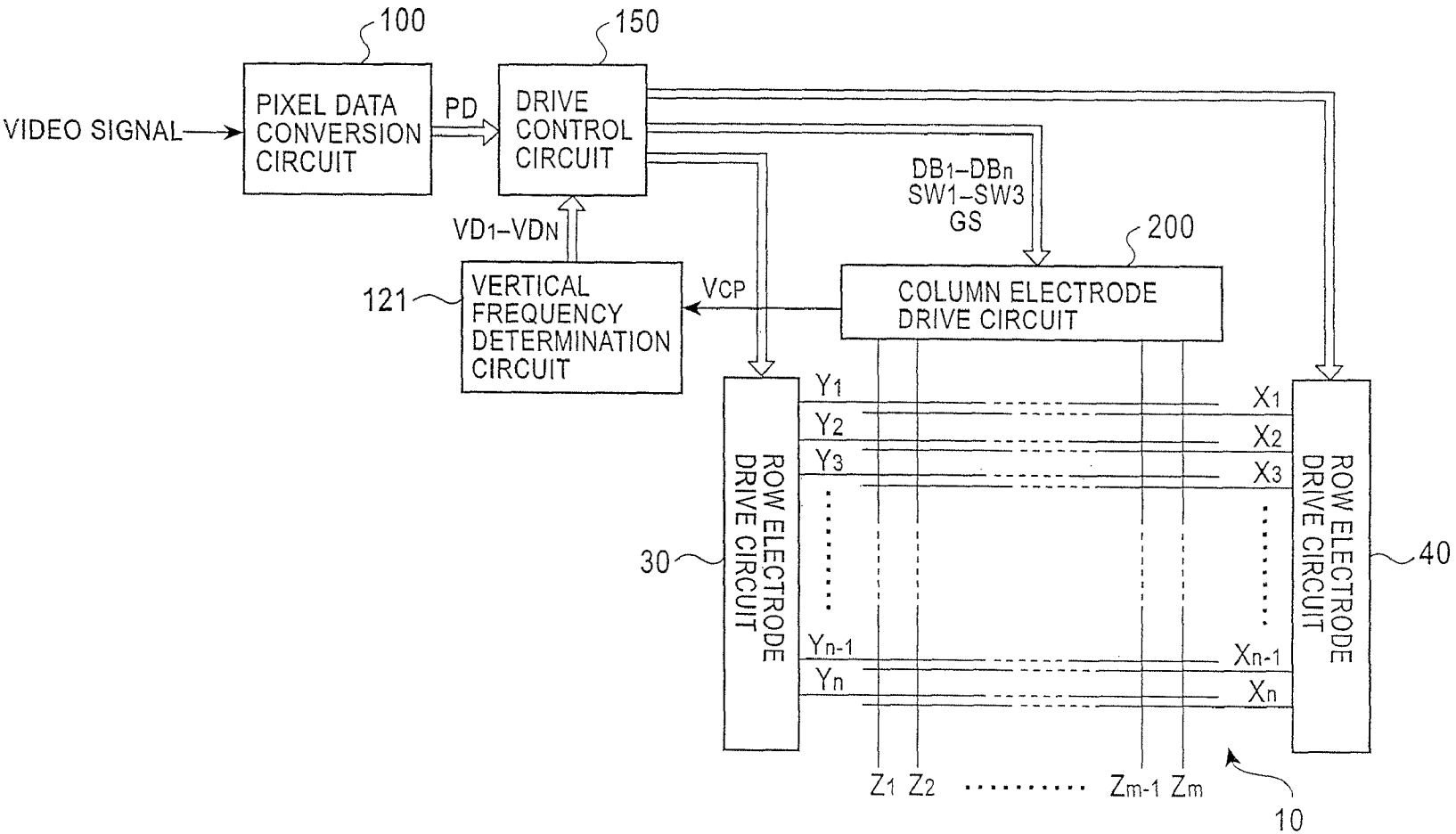
FIG. 12 is a view illustrating another exemplary configuration of a plasma display device incorporating a display panel drive apparatus according to the present invention.

FIG. 12 is a view illustrating another configuration of a plasma display device that has been developed from that point of view.

The components included in the plasma display device shown in FIG. 12, other than a vertical frequency determination circuit 121, are identical to those shown in FIG. 5 and thus their operation will not be described.

The vertical frequency determination circuit 121 of FIG. 12 determines whether a voltage $V_{CP}$ appearing at one end of the capacitor C1 used for charge recovery in the column electrode drive circuit 200 shown in FIG. 7 is higher than a predetermined voltage. That is, the voltage $V_{CP}$ at the one end of the capacitor C1 is equal to the central voltage Vc (indicated by alternate long and short dashed lines in FIG. 10) of the resonance amplitude $V_1$ of the pulsed supply voltage. Thus, when the voltage $V_{CP}$ is higher than the predetermined voltage, the vertical frequency determination circuit 121 determines that the input video signal has a frequency lower than the predetermined frequency in the vertical direction of the screen. On the other hand, when the voltage $V_{CP}$ is lower than the predetermined voltage, the vertical frequency determination circuit 121 determines that the input video signal has a frequency higher than the predetermined frequency in the vertical direction of the screen. The vertical frequency determination circuit 121 makes the aforementioned determination for each of the sub-fields SF1 to SF(N), and then supplies the vertical frequency determination signals $VD_1$ to $VD_N$ indicative of the result of the determination for each sub-field to the drive control circuit 150.

On the other hand, the aforementioned determination on whether the input video signal (the pixel data bits DB) has a frequency lower than a predetermined frequency in the vertical direction of the screen may also be made in accordance with the amount of current sent from the power supply B1 of the power supply circuit 21 shown in FIG. 7.

Figure 13:
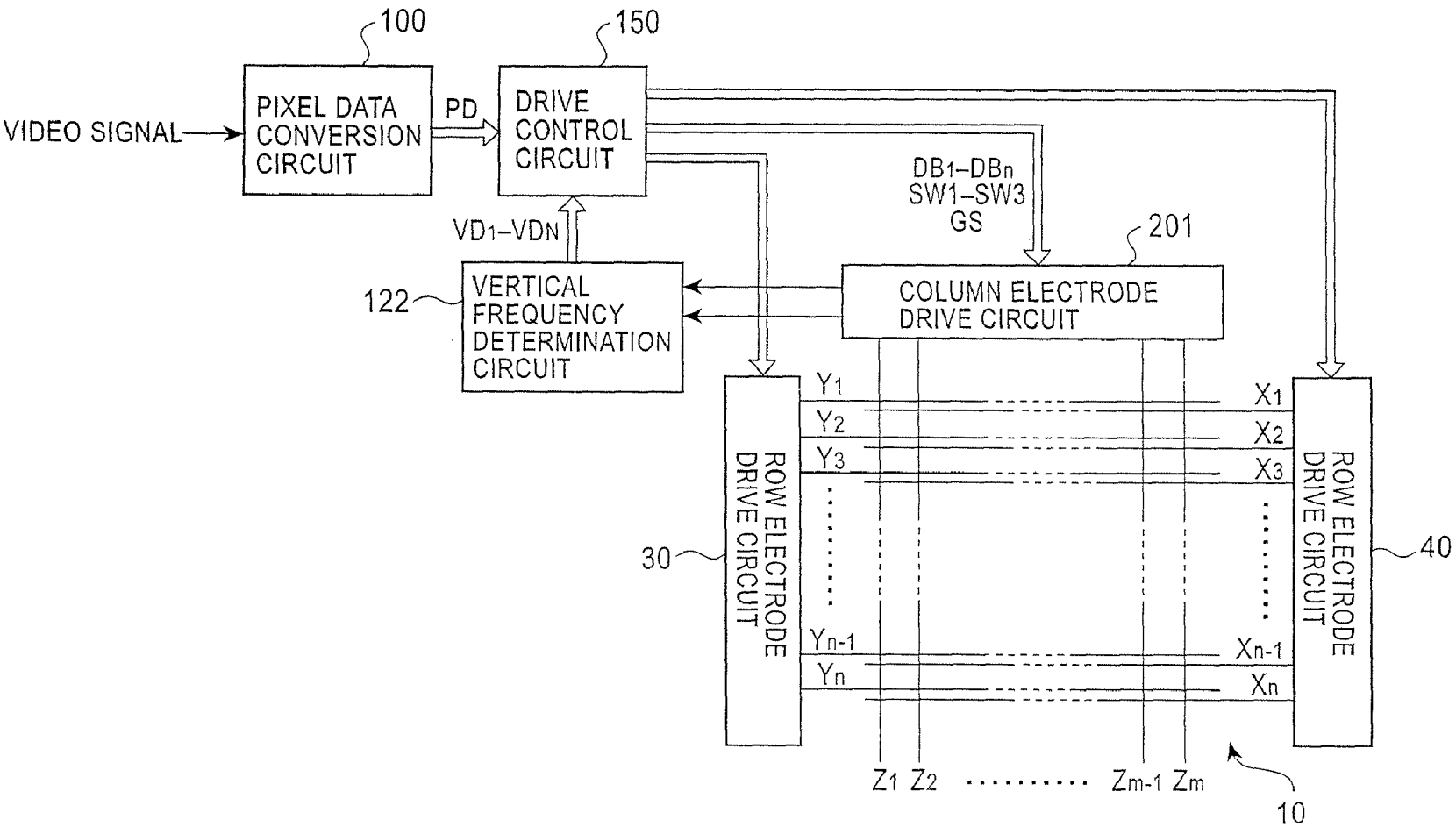
FIG. 13 is a view illustrating still another exemplary configuration of a plasma display device incorporating a display panel drive apparatus according to the present invention.

FIG. 13 is a view illustrating still another configuration of a plasma display device that has been developed from that point of view.

The components in the plasma display device shown in FIG. 13, other than a vertical frequency determination circuit 122 and a column electrode drive circuit 201, are identical to those shown in FIG. 5 and thus their operation will not be described.

Figure 14:
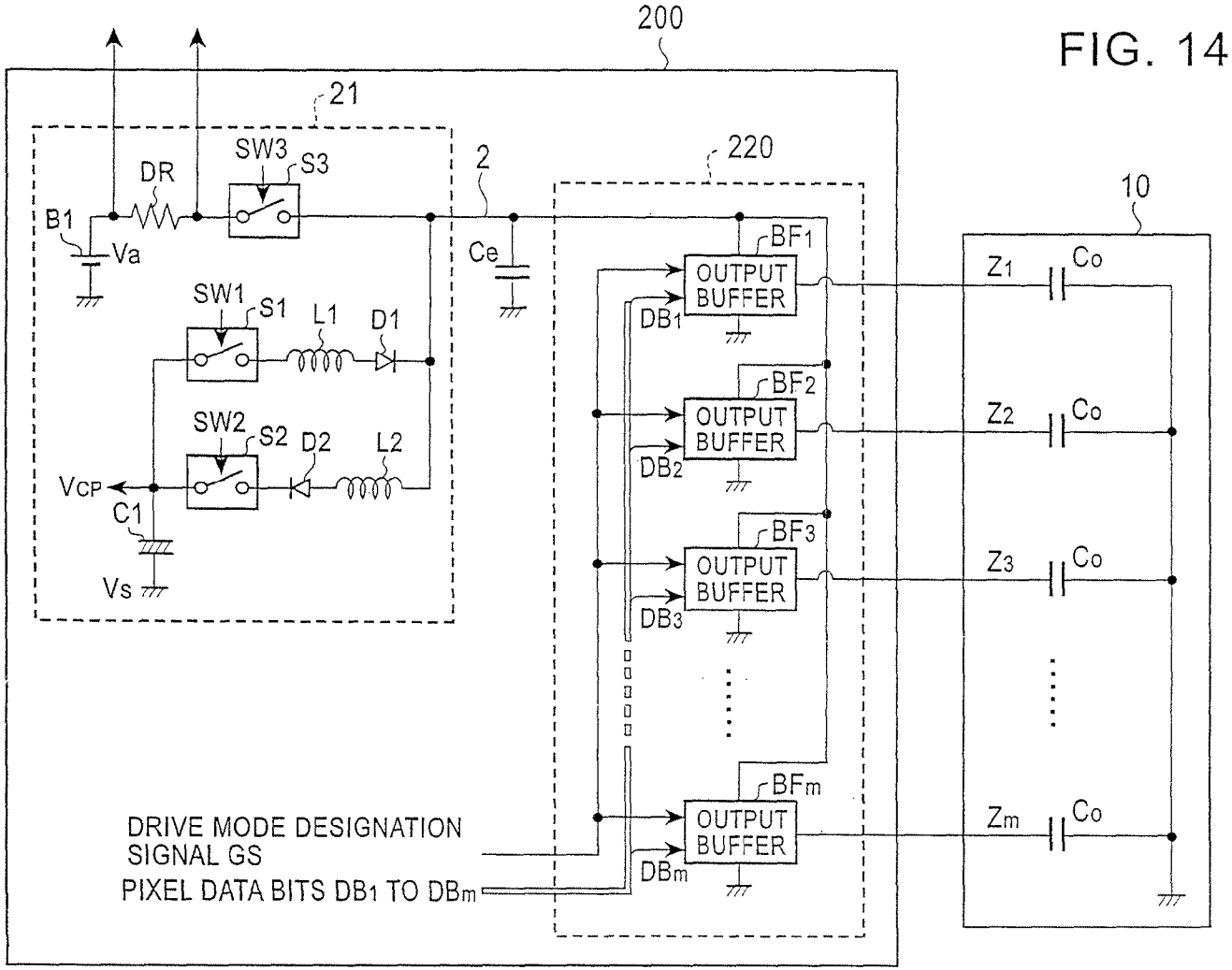
FIG. 14 is a view illustrating an exemplary internal configuration of a column electrode drive circuit 200 shown in FIG. 13.

FIG. 14 is a view illustrating the internal configuration of such a column electrode drive circuit 201.

Note that the column electrode drive circuit 201 shown in FIG. 14 has a dummy resistor DR used for current detection and interposed between the power supply B1 of the power supply circuit 21 and the switching element S3, the other components being identical to those shown in FIG. 7.

With this configuration, the vertical frequency determination circuit 122 shown in FIG. 13 measures a current flowing between the power supply B1 and the switching element S3 based on a voltage across the dummy resistor DR shown in FIG. 14. Then, based on the amount of current measured, the vertical frequency determination circuit 122 makes a determination, for each of the sub-fields SF1 to SF(N), on whether the input video signal has a frequency lower than a predetermined frequency in the vertical direction of the screen. The circuit 122 then supplies the vertical frequency determination signals $VD_1$ to $VD_N$ each indicative of the result of the determination for each sub-field to the drive control circuit 150.

Furthermore, the aforementioned embodiment is adapted to control the drive capability of each output buffer BF in each address step W of the sub-fields SF1 to SF(N); however, the drive capability of the output buffer BF may also be controlled in the sustain step I.

With this configuration, for example, the drive control circuit 150 supplies the pixel data bits $DB_1$ to $DB_m$ at logic level "1," for turning ON every switch unit $SWZ_{i0}$ of each of the output buffers $BF_1$ to $BF_n$, to the column electrode drive circuit 200 for the duration of the sustain step I. Meanwhile, in the sustain step I, the sustain pulse is repetitively applied alternately to the row electrodes X and Y of the PDP 10, and the application of the sustain pulse causes a current to flow into the switch unit $SWZ_{i0}$ of each of the output buffers $BF_1$ to $BF_n$. Accordingly, such a current flowing into the switch unit $SWZ_{i0}$ causes heat generation therein. In this context, the drive control circuit 150 supplies the drive mode designation signal GS at logic level "1" to the column electrode drive circuit 200 in order to set each of the output buffers $BF_1$ to $BF_n$ at the high drive mode for the duration of such a sustain step I. This allows for reducing heat generation in the switch unit $SWZ_{i0}$ during the sustain step I. At this time, in the address step W of each of the sub-fields SF1 to SF(N), the drive mode designation signal GS at logic level "0" is supplied to the column electrode drive circuit 200 in order to set each of the output buffers $BF_1$ to $BF_n$ to the low drive mode. This is done irrespective of the frequency of the input video signal (the pixel data bit DB) in the vertical direction of the screen.

As such, in the address step W, the output buffers $BF_1$ to $BF_n$ are set to the low drive mode, thereby allowing the voltage at the edge portion of a pulse applied to the PDP 10 to change gradually and thereby reducing noise. Additionally, in the sustain step I, all the output buffers $BF_1$ to $BF_n$ are set to the high drive mode, thereby reducing heat generation.

Note that at this time, the output buffer BF may not be set at the low drive mode all the time within the duration of the address step W. However, the output buffer BF may be set to the low drive mode at least during a pixel data write operation performed finally in the address step W, i.e., only during a pixel data write operation performed on a pixel cell that belongs to the nth display line. That is, the drive control circuit 150 supplies, to the column electrode drive circuit 200, the drive mode designation signal GS at logic level "0" for setting the output buffer BF to the high drive mode for the duration of application of the scan pulse to each of the row electrodes $Y_1$ to $Y_{n-1}$. Only when the scan pulse is applied to the last row electrode $Y_n$, the drive control circuit 150 supplies, to the column electrode drive circuit 200, the drive mode designation signal GS at logic level "0" for setting the output buffer BF to the low drive mode.

On the other hand, switching control may be provided to the drive capability of the output buffer BF both in the address step W and the sustain step I as described above. To this end, in the address step W, the drive mode of the output buffer BF may be set in accordance with the frequency of the input video signal in the vertical direction of the screen, while in the sustain step I, the output buffer BF may be fixedly set in the high drive mode. That is, in the address step W, the drive control circuit 150 supplies the drive mode designation signal GS to the column electrode drive circuit 200. Here, the drive mode designation signal GS sets the output buffer BF either to the high drive mode when the input video signal has a frequency higher than a predetermined frequency in the vertical direction of the screen, or to the low drive mode when the input video signal has a frequency lower than the predetermined frequency. On the other hand, in the sustain step I, the drive control circuit 150 supplies, to the column electrode drive circuit 200, the drive mode designation signal GS for setting each output buffer BF to the high drive mode.

This application is based on Japanese Patent Application No. 2005-361432 which is hereby incorporated by reference.

What is claimed is:

1. A display panel drive apparatus for driving a plasma display panel on pixel-by-pixel basis in accordance with pixel data derived from an input video signal, the display panel having a capacitive pixel cell at each portion of intersection of a plurality of row electrodes and a plurality of column electrodes, the drive apparatus comprising:

a power supply circuit for producing a pulsed supply voltage having a predetermined peak voltage for application to a power supply line;

a pixel data pulse generation circuit for producing a pixel data pulse having a voltage associated with the pixel data in accordance with the pulsed supply voltage for application to the column electrode, the pixel data pulse generation circuit including a first switch for connecting between the power supply line and one of the column electrodes in accordance with the pixel data, and a second switch for connecting the one column electrode to a ground line in accordance with the pixel data; and a controller for decreasing a current drive capability of said second switch as a frequency of the pixel data in a vertical direction of a screen of the display panel lowers, wherein said second switch is made up of a plurality of transistors each having a drain terminal directly connected to said one column electrode and a source terminal directly connected to said ground line, and said controller includes means for fixing at least one of said transistors to off state when said frequency of the pixel data in the vertical direction of said screen is lower than a predetermined frequency.

2. The display panel drive apparatus according to claim 1, wherein as a frequency of the pixel data in a vertical direction of a screen of the display panel lowers, the power supply circuit reduces the pulsed supply voltage in amplitude with the predetermined peak voltage remaining unchanged.

3. The display panel drive apparatus according to claim 1, wherein a unit display period of the input video signal comprises a plurality of sub-fields, each sub-field including an address period and a sustain period, the address period during which a pixel data write operation is performed to set each of the pixel cells to either an ON mode state or an OFF mode state on each display line basis in accordance with the pixel data, the sustain period during which only those of the pixel cells that are placed in the ON mode are allowed to emit light repetitively, and said controller specifies said current drive capability to send a different amount of current during the address period and during the sustain period.

4. The display panel drive apparatus according to claim 3, wherein the controller specifies said current drive capability to send a smaller current during the address period than during the sustain period.

5. The display panel drive apparatus according to claim 3, wherein the pixel data having a higher frequency in the vertical screen direction of the display panel causes the controller to specify said current drive capability to send a larger high current during the address period when compared with a case of the pixel data having a lower frequency, and during the sustain period, the controller specifies said current drive capability to send the high current.

6. The display panel drive apparatus according to claim 3, wherein in the pixel data write operation performed finally during the address period, the controller specifies said current drive capability to send a lower current than in any other period of the address period.

7. The display panel drives apparatus according to claim 1, wherein the power supply circuit comprises a capacitor, a first switching current path for allowing charges stored on the capacitor to be discharged and selectively be supplied to the power supply line via a first coil, a second switching current path for selectively applying the same DC voltage as the predetermined peak voltage to the power supply line, and a third switching current path for allowing charges stored on the column electrode to selectively charge the capacitor via the power supply line and a second coil.

* * * * *